US007108900B1

(12) United States Patent
Manning Porter

(10) Patent No.: US 7,108,900 B1
(45) Date of Patent: Sep. 19, 2006

(54) BREATHABLE GARMENT BAG SYSTEM

(76) Inventor: Anna Leta Manning Porter, 1610 W. Del Webb Blvd., Sun City Center, FL (US) 33573

( * ) Notice: Subject to any disclaimer, the term of this patent is extended or adjusted under 35 U.S.C. 154(b) by 227 days.

(21) Appl. No.: 10/830,809

(22) Filed: Apr. 23, 2004

Related U.S. Application Data

(63) Continuation-in-part of application No. 10/192,879, filed on Sep. 19, 2002, now abandoned.

(51) Int. Cl.
*B32B 1/02* (2006.01)

(52) U.S. Cl. ..... 428/35.7; 428/34.1; 428/34.3; 428/35.7; 428/35.9; 428/474.4; 206/287.1

(58) Field of Classification Search ..... 428/34.1, 428/34.3, 35.7, 35.9, 474.4; 206/287.1
See application file for complete search history.

(56) References Cited

U.S. PATENT DOCUMENTS 3,330,321 A * 7/1967 Wels ..... 383/23
5,090,559 A * 2/1992 Gendreau ..... 206/278
5,544,364 A * 8/1996 Weber ..... 2/104

* cited by examiner

*Primary Examiner*—Marc A. Patterson
(74) *Attorney, Agent, or Firm*—Edward P. Dutkiewicz

(57) ABSTRACT

A bag protects apparel. The bag is of a sheer woven fabric comprised of nylon threads. The fabric has a circular cross section with a diameter of about 0.004 inches plus or minus 10 percent and a thread count of between about 80 and 160 threads per inch. The fabric includes rectangular openings. The openings form between about 40 percent and 70 percent of the surface area of the fabric. The woven fabric of the primary bag has front and rear panels. The fabric has peripheral coupling seams. An opening above the side seams provides for the passage of a hook of a hanger there through. Horizontal shoulder seams between the side seams and the neck seams are supported by a garment on a hanger. The primary bag has an open bottom for the introduction of a garment on a hanger thereto or the removal there from the front panel.

1 Claim, 2 Drawing Sheets

BREATHABLE GARMENT BAG SYSTEM

RELATED APPLICATION

The instant patent application is a continuation-in-part of U.S. patent application Ser. No. 10/192,879 filed Sep. 19, 2002, now abandoned.

BACKGROUND OF THE INVENTION

1. Field of the Invention

The present invention relates to a breathable garment bag system and more particularly pertains to protecting covered garments from environmental damage while abating unpleasant odors in such covered garments.

2. Description of the Prior Art

The use of garment bags of known designs and configurations is known in the prior art. More specifically, garment bags of known designs and configurations previously devised and utilized for the purpose of protecting/carrying garments through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,330,321 issued Jul. 11, 1967 to Wels relates to an infant's wardrobe enclosing and carrying bag. U.S. Pat. No. 5,090,559 issued Feb. 25, 1992 to Gendreau relates to reusable garment bags for dry-cleaning. Lastly, U.S. Pat. No. 5,544,364 issued Aug. 13, 1996 to Weber relates to a nursing apron.

While these devices fulfill their respective, particular objectives and requirements, the aforementioned patents do not describe breathable garment bag system that allows protecting covered garments from environmental damage while abating unpleasant odors in such covered garments.

In this respect, the breathable garment bag system according to the present invention substantially departs from the conventional concepts and designs of the prior art, and in doing so provides an apparatus primarily developed for the purpose of protecting covered garments from environmental damage while abating unpleasant odors in such covered garments.

Therefore, it can be appreciated that there exists a continuing need for a new and improved breathable garment bag system which can be used for protecting covered garments from environmental damage while abating unpleasant odors in such covered garments. In this regard, the present invention substantially fulfills this need.

SUMMARY OF THE INVENTION

In view of the foregoing disadvantages inherent in the known types of garment bags of known designs and configurations now present in the prior art, the present invention provides an improved breathable garment bag system. As such, the general purpose of the present invention, which will be described subsequently in greater detail, is to provide a new and improved breathable garment bag system and method which has all the advantages of the prior art and none of the disadvantages.

To attain this, the present invention essentially comprises a primary bag. The primary bag protects short dresses, shirts and suits and the like. The primary bag is constructed of a sheer woven fabric. The sheer woven fabric is comprised of nylon threads. Each thread has a circular cross section with a diameter of about 0.004 inches plus or minus 10 percent with a count of between about 80 and 160 threads per inch. The woven fabric includes rectangular openings. The openings form between about 40 percent and 70 percent of the surface area of the fabric for viewing the garment there within. The woven fabric of the primary bag has a front panel and a rear panel. Coupling peripheral seams are provided. The seams include peripheral vertical side seams and essentially vertical neck seams. An opening is provided above the side seams. In this manner a hook of a hanger may pass through. Generally horizontal shoulder seams are provided between the side seams and the neck seams for being supported by a garment on a hanger. The primary bag has an open bottom. An overcast stitch is provided around the open bottom for the introduction of a garment on a hanger or the removal there from. The front panel and the rear panel have an axial length L of about 40 inches plus or minus 10 percent. The front panel and the rear panel have a width W between the side seams of about 20 inches plus or minus 10 percent when essentially flat during operation and use. The length to width ratio is between about 1.9 to 1 and 2.1 to 1.

A secondary bag is provided. The secondary bag protects shoulders, scarves and gloves and the like. The secondary bag is constructed as the primary bag except for a shortened length of about 10 inches plus or minus 10 percent. The secondary bag has a length to width ratio between about 0.4 to 1 and 0.6 to 1.

Provided last is a tertiary bag. The tertiary bag protects long dresses, pants suits, overcoats and gowns and the like. The tertiary bag is constructed as the primary and secondary bags except for an extended length of about 60 inches plus or minus 10 percent. The tertiary bag has a length to width ratio between about 2.9 to 1 and 3.1 to 1.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved breathable garment bag system which has all of the advantages of the prior art garment bags of known designs and configurations and none of the disadvantages.

It is another object of the present invention to provide a new and improved breathable garment bag system which may be easily and efficiently manufactured and marketed.

It is further object of the present invention to provide a new and improved breathable garment bag system which is of durable and reliable constructions.

An even further object of the present invention is to provide a new and improved breathable garment bag system which is susceptible of a low cost of manufacture with regard to both materials and labor, and which accordingly is then susceptible of low prices of sale to the consuming public, thereby making such breathable garment bag system economically available to the buying public.

Even still another object of the present invention is to provide a breathable garment bag system for protecting covered garments from environmental damage while abating unpleasant odors in such covered garments.

Lastly, it is an object of the present invention to provide a new and improved breathable garment bag system. A bag protects apparel. The bag is of a sheer woven fabric comprised of nylon threads. The fabric has a circular cross section with a diameter of about 0.004 inches plus or minus 10 percent and a thread count of between about 80 and 160 threads per inch. The fabric includes rectangular openings. The openings form between about 40 percent and 70 percent of the surface area of the fabric. The woven fabric of the primary bag has front and rear panels. The fabric has peripheral coupling seams. An opening above the side seams provides for the passage of a hook of a hanger there through. Horizontal shoulder seams between the side seams and the neck seams are supported by a garment on a hanger. The primary bag has an open bottom for the introduction of a garment on a hanger thereto or the removal there from the front panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
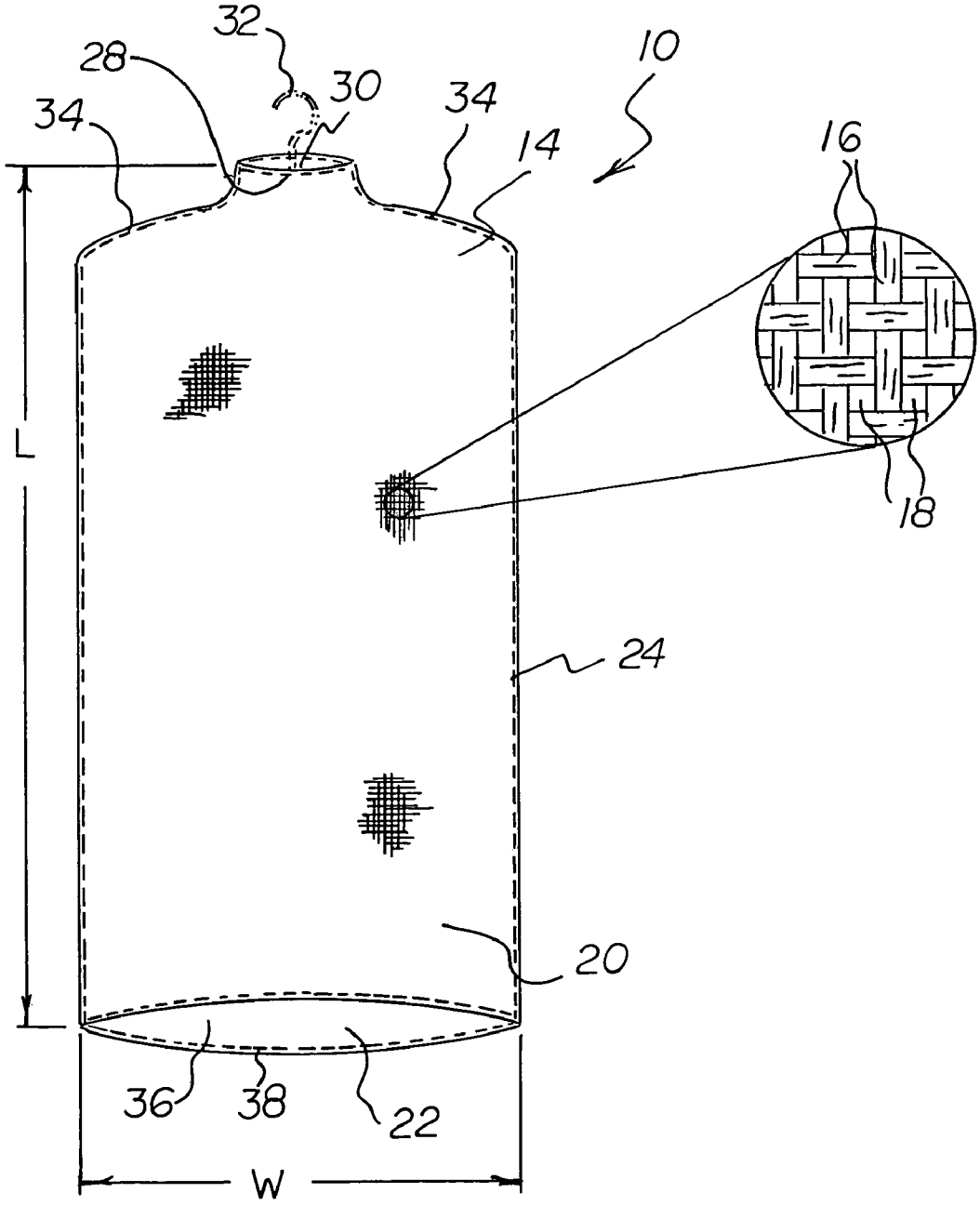
FIG. 1 is a front elevational view of the primary bag constructed in accordance with the principles of the present invention.
Figure 2:
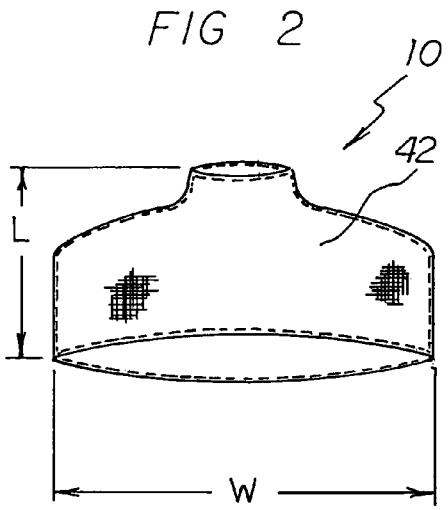
FIGS. 2 and 3 are a front elevational views of the secondary and tertiary bags constructed in accordance with the principles of the present invention.
Figure 3:
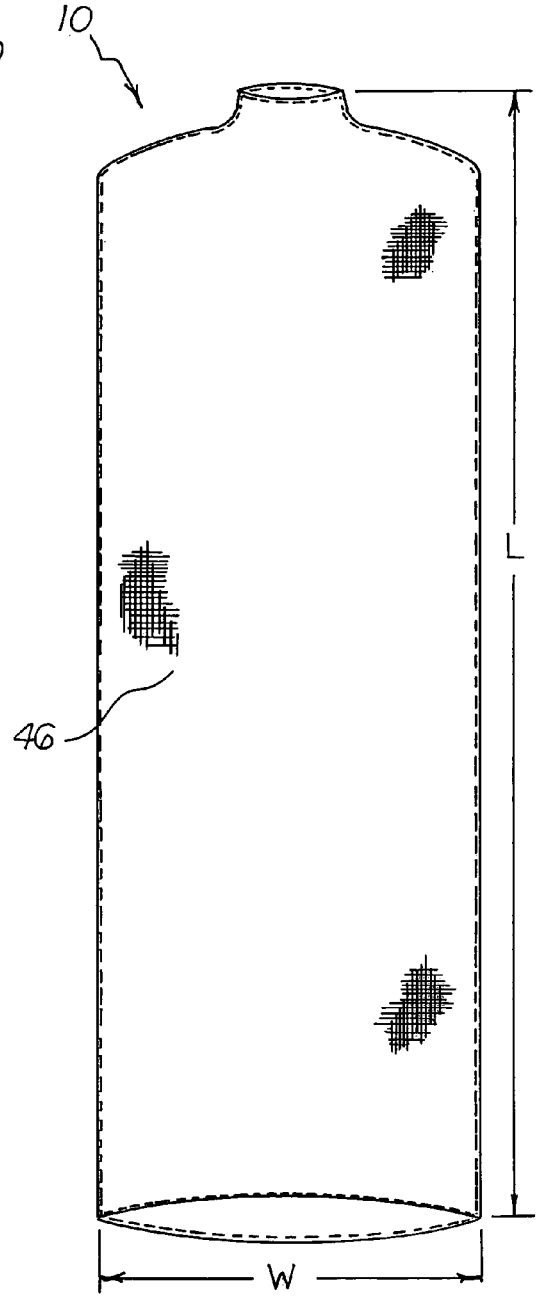

With reference now to the drawings, and in particular to FIG. 1 thereof, the preferred embodiment of the new and improved breathable garment bag system embodying the principles and concepts of the present invention and generally designated by the reference numeral 10 will be described.

The present invention, the breathable garment bag system 10 is comprised of a plurality of bags including a primary bag and a smaller secondary bag and a larger tertiary bag, each bag of a woven fabric, 100 percent nylon, sufficiently sheer to allow viewing a garment being protected by a bag.

First provided is a primary bag 14. The primary bag protects short skirts, shirts and suits and the like. The primary bag is constructed of a sheer woven fabric. The sheer woven fabric is comprised of nylon threads 16. Each thread has a circular cross section with a diameter of about 0.004 inches plus or minus 10 percent with a count of between about 80 and 160 threads per inch. The woven fabric includes rectangular openings 18. The openings form between about 40 percent and 70 percent of the surface area of the fabric for viewing the garment there within. The woven fabric of the primary bag has a front panel 20 and a rear panel 22. Coupling peripheral seams are provided. The seams include peripheral vertical side seams 24 and essentially vertical neck seams 28. An opening 30 is provided above the side seams. In this manner a hook of a hanger 32 may pass through. Generally horizontal shoulder seams 34 are provided between the side seams and the neck seams for being supported by a garment on a hanger. The primary bag has an open bottom 36. An overcast stitch 38 is provided around the open bottom for the introduction of a garment on a hanger or the removal there from. The front panel and the rear panel have an axial length L of about 40 inches plus or minus 10 percent. The front panel and the rear panel have a width W between the side seams of about 20 inches plus or minus 10 percent when essentially flat during operation and use. The length to width ratio is between about 1.9 to 1 and 2.1 to 1.

A secondary bag 42 is provided. The secondary bag protects shoulders, scarves and gloves and the like. The secondary bag is constructed as the primary bag except for a shortened length of about 10 inches plus or minus 10 percent. The front panel and the rear panel have a width W between the side seams of about 20 inches plus or minus 10 percent when essentially flat during operation and use. The secondary bag has a length to width ratio between about 0.4 to 1 and 0.6 to 1.

Provided last is a tertiary bag 46. The tertiary bag protects long dresses, pants suits, overcoats and gowns and the like. The tertiary bag is constructed as the primary and secondary bags except for an extended length of about 60 inches plus or minus 10 percent. The front panel and the rear panel have a width W between the side seams of about 20 inches plus or minus 10 percent when essentially flat during operation and use. The tertiary bag has a length to width ratio between about 2.9 to 1 and 3.1 to 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A breathable garment bag system for protecting covered garments from environmental damage while abating unpleasant odors in such covered garments comprising, in combination:

a primary bag for the protection of short dresses, shirts and suits and the like, the primary bag being constructed of a sheer woven fabric, the sheer woven fabric being comprised of nylon threads, each thread having a circular cross section with a diameter of about 0.004 inches plus or minus 10 percent, and a thread count of between about 80 and 160 threads per inch, whereby rectangular openings form between about 40 percent and 70 percent of the surface area of the fabric for viewing the garment there within, the woven fabric of the primary bag having a front panel and a rear panel and coupling peripheral seams including peripheral vertical side seams and essentially vertical neck seams with an opening above the side seams for the passage of a hook of a hanger there through and generally horizontal shoulder seams between the side seams and the neck seams for being supported by a garment on a hanger, the primary bag having an open bottom with an overcast stitch there around for the introduction of a garment on a hanger thereto or the removal there from the front panel and the rear panel having an axial length L of about 40 inches plus or minus 10 percent and a width W between the side seams of about 20 inches plus or minus 10 percent when essentially flat during operation and use, the length to width ratio being between about 1.9 to 1 and 2.1 to 1;

a secondary bag for the protection of shoulders, scarves and gloves and the like, the secondary bag being constructed as the primary bag except for a shortened length of about 10 inches plus or minus 10 percent and a width W between the side seams of about 20 inches plus or minus 10 percent when essentially flat during operation and use, with a length L to width ratio being between about 0.4 to 1 and 0.6 to 1; and a tertiary bag for the protection of long dresses, pants suits, overcoats and gowns and the like, the tertiary bag being constructed as the primary and secondary bags except for an extended length L of about 60 inches plus or minus 10 percent and a width W between the side seams of about 20 inches plus or minus 10 percent when essentially flat during operation and use, with a length to width ratio being between about 2.9 to 1 and 3.1 to 1.

* * * * *